US007481892B2

(12) United States Patent
Rosenbauer

(10) Patent No.: US 7,481,892 B2
(45) **Date of Patent: *Jan. 27, 2009**

(54) METHOD FOR ADAPTING A RINSING PROGRAM IN A DISHWASHER MACHINE, AND CORRESPONDING DISHWASHER MACHINE

(75) Inventor: Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 137 days.

This patent is subject to a terminal disclaimer.

(21) Appl. No.: 11/043,461

(22) Filed: Jan. 26, 2005

(65) Prior Publication Data

US 2005/0133064 A1 Jun. 23, 2005

Related U.S. Application Data

(63) Continuation of application No. PCT/EP03/09244, filed on Aug. 20, 2003.

(30) Foreign Application Priority Data

Aug. 21, 2002 (DE) ..... 102 38 303

(51) Int. Cl.
*B08B 7/00* (2006.01)

(52) U.S. Cl. ..... 134/18; 134/25.2; 134/56 D; 134/58 D

(58) Field of Classification Search ..... 134/18, 134/25.2, 56 D, 57 D, 58 D
See application file for complete search history.

(56) References Cited

U.S. PATENT DOCUMENTS

| | | | | |
|---|---|---|---|---|
| 5,725,001 | A | 3/1998 | Vogel | |
| 5,806,541 | A * | 9/1998 | Cooper et al. | 134/57 D |
| 6,887,318 | B2 * | 5/2005 | Bashark | 134/18 |
| 2003/0079760 | A1 * | 5/2003 | Spanyer et al. | 134/18 |
| 2003/0213503 | A1 * | 11/2003 | Price et al. | 134/18 |
| 2003/0213505 | A1 * | 11/2003 | Price et al. | 134/25.2 |

FOREIGN PATENT DOCUMENTS

| | | | |
|---|---|---|---|
| DE | 29 49 254 | C2 | 6/1981 |
| DE | 38 39 204 | A1 | 5/1990 |
| DE | 295 14 412 | U1 | 11/1995 |
| DE | 196 29 806 | A1 | 1/1998 |
| DE | 196 44 438 | C2 | 4/1998 |
| DE | 100 57 210 | A1 | 5/2002 |
| EP | 0 972 487 | A1 | 1/2000 |
| EP | 1 188 409 | A2 | 3/2002 |
| EP | 1 195 128 | A2 | 4/2002 |

* cited by examiner

*Primary Examiner*—Michael Barr
*Assistant Examiner*—Saeed T Chaudhry
(74) *Attorney, Agent, or Firm*—Russell W. Wamock; James E. Howard

(57) ABSTRACT

A method for adapting a rinsing program in a dishwasher machine, and a dishwashing machine configured to perform the method, the method enabling the rinsing program run of a dishwasher machine to be adapted in such a way that satisfactory cleaning and drying performances are achieved even when using a combination rinse aid. To this end, the rinsing program run is adapted if a clear rinsing agent is not added, and if the dishwasher machine is on.

8 Claims, No Drawings

METHOD FOR ADAPTING A RINSING PROGRAM IN A DISHWASHER MACHINE, AND CORRESPONDING DISHWASHER MACHINE

The invention relates to a method for adapting a rinsing program in a dishwasher machine and a dishwasher machine for using this method.

In addition to the conventional use of dishwashing agent which is present in powder form and is inserted in a dishwashing agent dispensing device usually located in the door of the dishwasher machine and is dispensed by this at a pre-determined time and in addition to the use of liquid rinse aid which is also inserted in a dishwashing agent dispensing device usually located in the door of the dishwasher machine and is dispensed by this at a pre-determined time and in a pre-determined quantity, agents in a tablet form of administration have been known for some time, which not only contain the actual dishwashing agent but also those components required as consumables during a rinsing phase. Thus, for example, combination products have been known for some time, so-called "2 in 1 tabs" or "2 in 1 gels" and "3 in 1 tabs" or "3 in 1 gels" which in addition to the dishwashing agent, also at least contain the rinse aid. According to the idea of the manufacturers of these tabs or gels, the respective components are used precisely at that time during the rinsing program run at which these components have their optimal effect.

However, since the rinsing program run depends both on the rinsing program selected in each case, the manufacturer of the dishwasher machine and also on individual model types, the use of tabs or gels can have the result that for example, the rinse aid is released into the rinsing solution at a time when no rinsing is taking place so that in an actual partial program section "rinse", there is no more corresponding rinse aid. This is because in some known tabs or gels, the release of the rinse aid is merely coupled to the ambient temperature so that when this temperature is exceeded during a partial program section "clean", rinse aid is released.

In another embodiment of the rinsing program it can be that the rinse aid is not activated so that likewise no rinsing effect is achieved, in which case however the rinse aid is still present in undissolved form, for example, after the end of the rinsing program.

Since the rinse aid usually primarily has the function of breaking down the surface tension of the rinsing solution, the lack of rinse aid in the rinsing solution results in reduced flowing away of the residual water remaining on the items to be cleaned in the partial program section "dry" which yields a substantially inferior drying result compared with the use of a rinsing solution with a rinse aid component.

As a consequence of this use of tabs or gels, the user of the dishwasher machine can detect that the cleaning performance and/or the drying performance is not satisfactory and in many cases causatively attributes this result to the dishwasher machine although the cause lies mainly in the use of tabs or gels.

The object of the present invention is thus to provide a method which allows the rinsing program run of a dishwasher machine to be adapted so that even when using combination dishwashing agents, a satisfactory cleaning and drying performance is achieved.

This object is solved by the method according to the invention with the features according to claim 1 and by the dishwasher machine with the features according to the further independent claim. Advantageous further developments of the inventions are characterised in the dependent claims.

In the method for adapting a rinsing program in a dishwasher machine according to the invention, the rinsing program run is adapted if it is detected that no rinse aid has been added and if the dishwasher machine is operating. By detecting the lack of rinse aid in conjunction with the operation of the dishwasher machine, it is established that either the user has forgotten to put in the rinse aid or that the tabs or gels described are being used. In both case, an adaptation of the rinsing program without any intervention of the user is provided according to the invention to achieve a satisfactory cleaning and drying performance.

According to a preferred feature of the invention, if it is detected that no rinse aid has been added and if the dishwasher machine is operating, during the rinsing program the number of changes of the solution in a partial program step "intermediate rinse" is reduced and/or the number of changes of solution in a partial program step "rinse" and/or the duration of a partial program step "dry" and/or the temperature associated therewith is increased. A reduced number of changes of solution in the partial program step "intermediate rinse", which is usually operated with clear water, makes it possible to reuse the cleaning solution in the rinsing whereby, if necessary, this "carried away" solution can take over the rinsing functions. An elevated temperature of the rinsing solution, especially in rinsing makes it possible to achieve better evaporation of the residual liquid remaining on the items to be cleaned which have been heated with the rinsing solution and thus makes it possible to achieve a satisfactory drying result. Lengthening of the rinsing also helps to achieve satisfactory heating and satisfactory residual cleaning of the items to be cleaned. The increase in temperature in the rinsing naturally also brings about an increased temperature in the drying, this lengthening ensuring a better evaporation of the residual liquid.

The present invention has succeeded in providing a method which allows the rinsing program run of a dishwasher machine to be adapted so that a satisfactory cleaning and drying performance is achieved even when using combination dishwashing agents.

More appropriately, the lack of addition of rinse aid is detected by means of a level of rinse aid in a rinse aid supply container being too low. Thus a sehsor usually present in any case is used for a further advantageous measure.

According to an advantageous embodiment of the invention, the lack of addition of rinse aid is detected by means of a sensor to measure the chemical properties of the corresponding rinsing solution. In contrast to the alkaline cleaning solution, the rinsing solution is acid when rinse aid is added, hence the sensor for measuring the properties of the rinsing solution is advantageously a pH sensor.

With such a sensor the concentration of any rinse aid still present in the rinsing solution can be determined by a comparison with a pre-determined value. Thus, in an especially advantageous fashion during the rinsing program the number of changes of the solution in a partial program step "intermediate rinse" and/or "rinse" and/or the duration of a partial program step "dry" and/or the temperature associated therewith is adapted according to the detected pH value.

The aforesaid object is solved by a dishwasher machine according to the invention for using a method according to one of the preceding claims.

According to an advantageous embodiment of the invention, a pH sensor for measuring the properties of the corresponding rinsing solution is arranged.

The present invention has succeeded in providing a method which allows the rinsing program run of a dishwasher machine to be adapted so that even when combination dishwashing agents are used, a satisfactory cleaning and drying performance is achieved.

The invention claimed is:

1. A method for adapting a rinsing program in a dishwasher machine, comprising:

adapting the rinsing program including selectively varying one of a rinse water content, a temperature of the rinse water, and a duration of application of the rinse water in response to a detection that no rinse aid has been added and the dishwasher machine is operating.

2. The method of claim 1, wherein the adapting includes one of reducing, during the rinsing program, the number of changes of the solution in a partial program step intermediate rinse, and reducing the number of changes of solution in a partial program step rinse.

3. The method according to claim 1, wherein the adapting the rinsing program includes detecting the absence of a rinse aid in an associated supply container above a predetermined minimum quantity.

4. The method according to claim 1, wherein the adapting the rinsing program includes detecting the absence of a rinse aid in an associated supply container above a predetermined minimum quantity via a sensor for measuring the chemical properties of the rinsing solution.

5. The method according to claim 4, wherein the adapting the rinsing program includes detecting via a pH sensor the absence of a rinse aid in an associated supply container above a predetermined minimum quantity.

6. The method according to claim 5, wherein the adapting the rinsing program in response to the detection that no rinse aid has been added and the dishwasher machine is operating includes at least one of adapting as a function of a detected pH value, during the rinsing program, the number of changes of the solution in a partial program step intermediate rinse, and adapting as a function of a detected pH value the number of changes of solution in a partial program step rinse.

7. A dishwasher machine, comprising:

a controller that adapts a rinsing program by selectively varying one of a rinse water content, a temperature of the rinse water, and a duration of application of the rinse water if it is detected that no rinse aid has been added and the dishwasher machine is operating.

8. The dishwasher machine according to claim 7, and further comprising a pH sensor for measuring the properties of the rinsing solution.

* * * * *